United States Patent [19]

Sakuranaka

[11] Patent Number: 4,610,234

[45] Date of Patent: Sep. 9, 1986

[54] INJECTION TIMING CONTROL DEVICE FOR DISTRIBUTOR-TYPE FUEL INJECTION PUMPS

[75] Inventor: Toru Sakuranaka, Konan, Japan

[73] Assignee: Diesel Kiki Co., Ltd., Tokyo, Japan

[21] Appl. No.: 742,614

[22] Filed: Jun. 7, 1985

[30] Foreign Application Priority Data

Jun. 12, 1984 [JP] Japan ..... 59-86870[U]

[51] Int. Cl.[4] ..... F02M 39/00

[52] U.S. Cl. ..... 123/502; 123/179 L

[58] Field of Search ..... 123/502, 449, 179 L, 123/500, 501

[56] References Cited

U.S. PATENT DOCUMENTS

| | | | |
|---|---|---|---|
| 4,224,916 | 9/1980 | Davis | 123/502 |
| 4,406,268 | 9/1983 | Eheim | 123/502 |
| 4,408,591 | 10/1983 | Nakamura | 123/502 |
| 4,422,428 | 12/1983 | Eheim | 123/502 |
| 4,432,327 | 2/1984 | Salzgeber | 123/502 |
| 4,476,837 | 10/1984 | Salzgeber | 123/501 |
| 4,501,252 | 2/1985 | Stumpp | 123/502 |

FOREIGN PATENT DOCUMENTS

| | | | |
|---|---|---|---|
| 3201914 | 8/1983 | Fed. Rep. of Germany | 123/502 |
| 55-49078 | 9/1953 | Japan | 123/502 |
| 58-163644 | 10/1983 | Japan | 123/502 |

*Primary Examiner*—Carl Stuart Miller

*Attorney, Agent, or Firm*—Frishauf, Holtz, Goodman & Woodward

[57] ABSTRACT

An injection timing control device in a distributor-type fuel injection pump is provided with a servo valve for preventing vibration of the timer piston caused by a torque reaction force of the roller holder. A spring force control device holds the initial setting load of the timer spring urging the valve body of the servo valve at a predetermined value when the engine temperature exceeds a predetermined value, and reduces the initial setting load below the predetermined value when the engine temperature is below the predetermined value, to thereby obtain an injection timing advance at the start of the engine in a cold condition.

2 Claims, 3 Drawing Figures

INJECTION TIMING CONTROL DEVICE FOR DISTRIBUTOR-TYPE FUEL INJECTION PUMPS

BACKGROUND OF THE INVENTION

This invention relates to an injection timing control device for distributor-type fuel injection pumps, and more particularly to improvements in starting advance means provided in fuel injection pumps of this kind for advancing the injection timing at the start of the engine in a cold condition such as in cold weather.

An injection timing control device provided in distributor-type fuel injection pumps for diesel engines typically comprises a roller holder carrying a plurality of rollers circumferentially arranged and disposed in camming engagement with an end face of a pumping and distributing plunger connected to the output shaft of an engine, a timer piston coupled to the roller holder and arranged to be urged at its one end face by fuel pressure variable as a function of the engine speed supplied from the suction chamber of the pump, and a timer spring arranged to urge the timer piston against the fuel pressure. The timer piston is therefore displaceable in response to a change in the engine speed to cause a corresponding change in the circumferential position of the roller holder, which in turn causes a change in the axial operative position of the plunger relative to the circumferential phase of the engine output shaft to vary the injection timing.

In the conventional injection timing control device, due to rotative contact of a cam disc integral with the plunger with the rollers on the roller holder, a torque reaction force acts upon the rollers so as to cause circumferential vibration of the roller holder, which vibration is transmitted to the timer piston to cause axial vibration thereof. As a consequence, fuel is alternately introduced into and discharged from a hydraulic oil chamber defined at the one end of the timer piston, to amplify the axial vibration of the timer piston, resulting in unstable control of the injection timing.

To prevent such phenomenon, an injection timing control device for distributor-type fuel injection pumps has been proposed by U.S. Pat. No. 4,408,591 assigned to the same assignee of the present application, which is provided with a servo valve disposed to separate the hydraulic oil chamber defined at one end of the timer piston from the suction chamber to thereby prevent vibration of the timer piston attributable to a torque reaction force acting thereon, during operation of the engine.

On the other hand, injection timing control devices of the aforementioned type are generally provided with injection timing advance means for obtaining a required injection timing advance at the start of the engine so as to facilitate starting of the engine in a cold condition. Conventionally, such injection timing advance means include a type in which an auxiliary piston is urged by a spring having a setting load larger than a timer spring urging a timer piston, to bias the timer piston in an injection timing-advanced position at the start of the engine in a cold condition, as disclosed in Japanese Provisional Patent Publication No. 55-49078, and a type in which a roller holder of the injection timing control device is rotated in the injection timing advancing direction directly by a starting injection timing advance lever driven by an actuator, at the start of the engine in a cold condition, as disclosed in Japanese Provisional Patent Publication No. 58-163644.

However, these conventionally proposed injection timing advance means are large in size and complicated in construction, and therefore are not suitable for use in an injection timing control device equipped with a servo valve, referred to hereinbefore.

SUMMARY OF THE INVENTION

It is the object of the invention to provide an injection timing control device for distributor-type fuel injection pumps, which is provided with injection timing advance means which is capable of positively and reliably obtaining an advance in the injection timing at the start of the engine in a cold condition, and which is simple in construction and can be designed compact in size and light in weight.

An injection timing control device according to the invention is provided with spring force control means which is responsive to a temperature of the engine for changing the initial setting load of the timer spring. The spring force control means comprises a thermo-sensitive element variable in volume in response to a change in the temperature of the engine, a spring seat member having one surface disposed in urging contact with an end of the timer spring and an opposite surface urged by the thermo-sensitive element against the urging force of the timer spring and displaceable in response to a change in the volume of the thermo-sensitive element for changing the initial length of the timer spring, and stopper means for holding the initial length of the timer spring at a value corresponding to a predetermined value of the initial setting load of the timer spring irrespective of change of the volume of the thermo-sensitive element when the temperature of the engine is higher than a predetermined value. The stopper means of the spring force control means is disposed to engage the spring seat member at a predetermined location for prohibiting displacement of the spring seat member toward the timer piston beyond the predetermined location. The spring force control means further includes a buffer spring urging the thermo-sensitive element against the force of the timer spring. The buffer spring is disposed to be contracted by an increase in the volume of the thermo-sensitive element when the spring seat member engages the stopper means.

The spring force control means constructed as above operates such that when the temperature of the engine is higher than the aforesaid predetermined value, it holds the initial setting load of the timer spring at the aforesaid predetermined value, while when the temperature of the engine is lower than the predetermined value, it reduces the initial setting load of the timer spring below the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
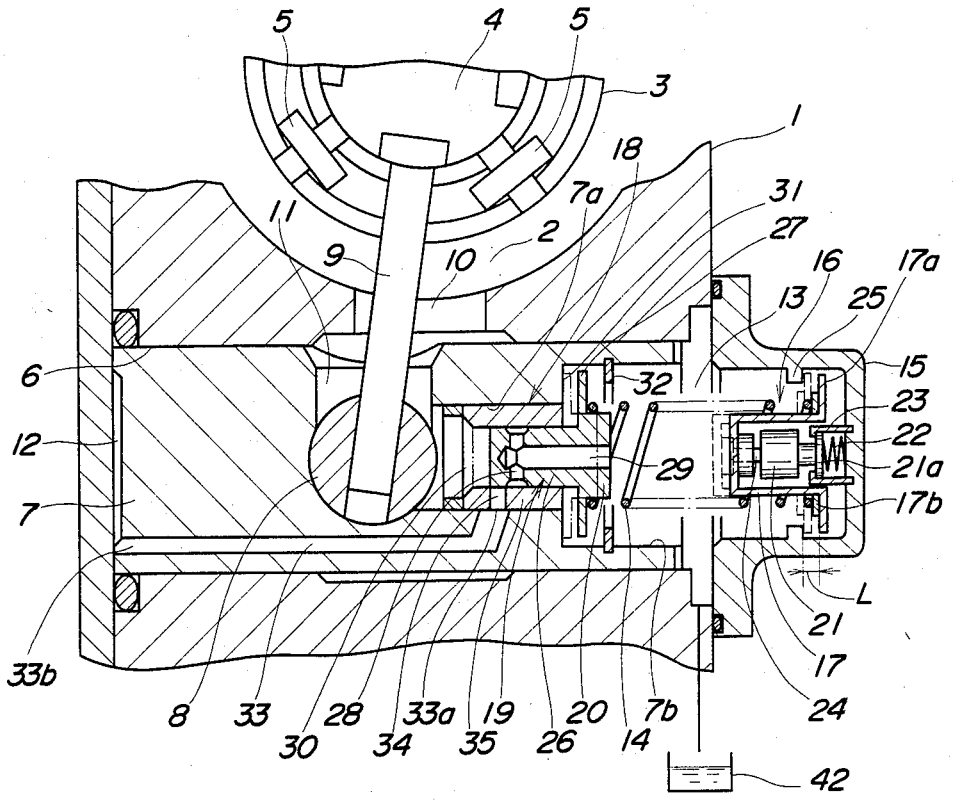
FIG. 1 is a longitudinal sectional view of an injection timing control device in a distributor-type fuel injection pump, according to a first embodiment of the present invention.

Referring first to FIG. 1, there are illustrated an injection timing control device and its peripheral parts in a distributor-type fuel injection pump, according to a first embodiment of the invention. In the figure, reference numeral 1 designates a pump housing within which is defined a suction space 2 filled with pressurized fuel under pressure proportional to the rotational speed of an internal combustion engine associated with the pump. Mounted within the suction space 2 is a roller holder 3 controllable in circumferential position, which has a central axial hole 4 in which is arranged a coupling means connecting between a drive shaft of the pump and a plunger of same, none of which are shown. The roller holder 3 carries a plurality of rollers 5 cirmferentially arranged around the central axial hole 4 at equal intervals, and disposed in rolling contact with the cam surface of a cam disc, not shown, secured to an end of the plunger.

An injection timing control device is provided at the bottom of the pump housing 1, which has a cylinder 6 fixed to the pump housing 1 within which is slidably received a timer piston 7. A rotary coupling 8 is mounted in the timer piston 7 at a central portion thereof for rotation about an axis perpendicular to the axis of the timer piston 7. Secured to the coupling 8 is one end of a connecting rod 9 which extends through a hole 10 formed in the pump housing 1 and a cavity 11 formed in the timer piston and is coupled at the other end to the roller holder 3.

Defined between an end face of the timer piston 7 and an opposed end face of the cylinder 6 is a hydraulic oil chamber 12 which is supplied with pressurized fuel under pressure proportional to the rotational speed of the engine, from the suction space 2. On the other hand, a spring chamber 13 accommodating a timer spring 14 is defined between the other end face of the timer piston 7 and an opposed other end face of the cylinder 6 and communicates with a fuel tank 42. The other end of the cylinder 6 is formed by a cap 15 having a generally U-shaped cross section, attached to the outer wall surface of the housing 1 by suitable means, not shown. A spring force control device 16 is mounted within the cap 15. This control device 16 is operable in response to the temperature of fuel flowing into the spring chamber 13 in such a manner that when the fuel temperature is higher than a predetermined value, it holds the initial setting load of the timer spring 14 exerted upon the timer piston 7 at a predetermined value which is usually employed in a conventional fuel injection control device, while when the fuel temperature is lower than the predetermined value, it acts to reduce the initial setting load below the predetermined value. The term "initial setting load" of the timer spring 14 is defined as a setting load which is given by the spring 14 when the timer piston 7 and a valve body of a servo valve 18, hereinafter referred to, both assume initial positions or left extreme positions as viewed in FIG. 1.

The spring force control device 16 is mainly composed of a spring seat member 17 having a hollow cylindrical shape, formed integrally with an annular flange **17*a* at an open end thereof, and a wax pellet (thermosensitive element) 21 arranged within the spring seat member 17. The wax pellet 21 has an end flange 21*a* axially slidably fitted within a hollow tubular member 23 projected from an inner end face of the cap 15 and urged by a buffer spring 22 mounted within the hollow tubular member 23. The spring seat member 17 has an opposite closed end wall to which is attached the other end of the wax pellet 21 by means of a rod 24. The timer spring 14 has one end fitted on the spring seat member 17 and urged against the annular flange 17*a* and an opposite end fitted on a spring seating enlarged end 20 formed integrally on one end of the valve body 19 of the above-mentioned servo valve 18, and urged against an annular flange 27 formed integrally on the enlarged end 20**.

When the temperature of fuel within the timer spring chamber 13 is lower than a predetermined value, the wax pellet has a reduced volume so that the spring seat member 17 assumes a position indicated by the solid lines in FIG. 1 wherein the timer spring 14 is expanded. On the other hand, when the fuel temperature is higher than the predetermined value, the wax pellet 21 has an increased volume so that the spring seat member 17 is leftwardly biased together with the rod 24 to assume a position indicated by the broken lines wherein the timer spring 14 is contracted. When the spring seat member 17 is in the position indicated by the broken lines, its annular flange **17*a* abuts against a stopper 25 projected on an inner peripheral surface of the cap 15. The buffer spring 22 acts to absorb a reaction force of the spring seat member 17 urged by the wax pellet 21 when it is further increased in volume after the annular flange 17*a* has been brought into contact with the stopper 25, to thereby prevent the annular flange 17*a* of the spring seat member 17, the stopper 25**, etc. from being damaged.

The servo valve 18 acts to prevent vibration of the timer piston 7 due to a torque reaction force of the roller holder 3, and particularly movement of the timer piston 7 in the injection timing retarding direction. The valve body 19 of the servo valve 18 has a main portion 26 of a circular cross section and having a predetermined axial size. The main portion 26 is formed therein with a first port 28 transversely extending through the other end thereof, and a second port 29 axially extending in the main portion 26 with one end intersecting with a central portion of the first port 28 and the other end opening in an end face of the main portion 26. A portion of the valve body 19 between the other end of the main portion 26 and the annular flange 27 is slidably fitted in a valve body chamber 30 defined in a sleeve 35 fitted in an axial hole **7*a* formed in the timer piston 7, for displacement of the valve body 19 relative to the timer piston 7 in such a manner that when the valve body 19 is moved to an extreme position toward the hydraulic oil chamber 12, the annular flange 27 is brought into urging contact with a stepped shoulder 31 at an end face of an end opening 7*b* in the timer piston 7 as indicated by the two-dot chain lines, whereas when it is moved to the opposite extreme position toward the spring chamber 13, the annular flange 27 is brought into urging contact with a stopper ring 32 fitted in the end opening 7*b* in the timer piston 7 at a location spaced from the stepped shoulder 31** by a predetermined distance.

The valve body chamber 30 communicates, on one hand, with the suction space 2 through the cavity 11 and the hole 10, and, on the other hand, with the hydraulic oil chamber 12 through a communication passage 33 formed within the timer piston 7. The communication passage 33 communicates at one end 33*a* with the valve body chamber 30 through a radial hole 34 formed in the sleeve 35, and at the other end 33*b* with the hydraulic oil chamber 12.

The operation of the injection timing control device according to the invention will now be described. First, before the start of the engine, regardless of whether the engine is in a cold condition or in a warm condition, the timer piston 7 is in the illustrated position, wherein the annular flange 27 of the valve body 19 is in urging contact with the stepped shoulder 31 of the timer piston 7 as indicated by the two-dot chain lines in FIG. 1. With the timer piston 7 in this position, the hydraulic oil chamber 12 communicates with the timer spring chamber 13 via the communication passage 33, the radial hole 34, the first port 28 of the valve body 19, and the second port 29.

Before the start of the engine in a cold condition when the fuel temperature is below the aforementioned predetermined value, the wax pellet 21 is reduced in volume so that the spring seat member 17 assumes a position indicated by the solid lines in FIG. 1, whereas before the start of the engine in a warm condition when the fuel temperature is above the predetermined value, the wax pellet 21 is increased in volume so that the spring seat member 17 is leftwardly biased to have its annular flange 17*a* brought into urging contact with the stopper 25, as indicated by the broken lines in FIG. 1.

Therefore, when the engine is in a cold condition, the initial length of the timer spring 14 that is assumed just before the start of the engine when the timer piston 7 and the valve body 19 of the servo valve 18 both assume initial positions or leftmost positions is larger than when the engine is not in a cold condition, by an amount corresponding to an amount of displacement L of the spring seat member 17, and accordingly the timer spring 14 has a correspondingly reduced initial setting load.

When the engine is started with the injection timing control device in this position, increased fuel pressure within the suction space 2 is transmitted into the valve body chamber 30 through the hole 10 and cavity 11 to urgingly bias the valve body 19 rightward against the force of the timer spring 14 into a position indicated by the solid lines in the figure, wherein the communication passage 33 has its open end partly opening into the valve body chamber 30 so that the hydraulic oil chamber 12 is disconnected from the timer spring chamber 13, and at the same time the hydraulic oil chamber 12 is communicated with the valve body chamber 30 through the radial hole 34 and the communication passage 33, to be supplied with the increased fuel pressure which causes rightward displacement of the timer piston 7 through a required starting advance stroke.

Figure 2:
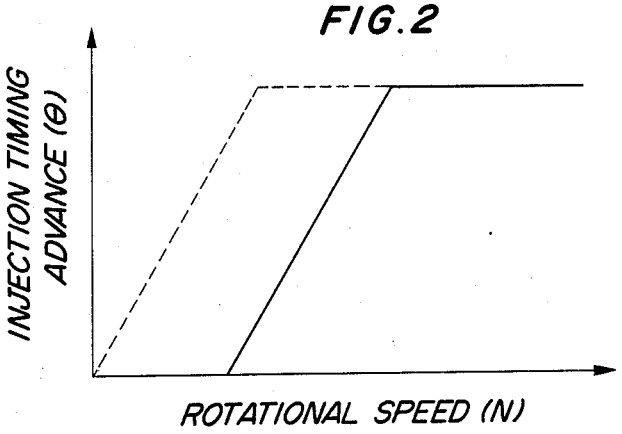
FIG. 2 is a graph showing an injection timing advance characteristic of the injection timing control device of FIG. 1.

When the engine is in a cold condition, the initial setting load of the timer spring 14 is reduced to a smaller value than when the engine is in a warm condition due to contraction of the wax pellet 21, as noted before. Therefore, even a slight increase in the fuel pressure within the suction space 2 causes rightward displacement of the timer piston 7 at the start of the engine, to obtain an advance in the injection timing as indicated by the broken line in FIG. 2, at an earlier time than when the engine is in a warm condition, i.e. at a time corresponding to a lower starting engine speed, as indicated by the solid line.

As the fuel temperature increases above the predetermined value with operation of the engine following the start thereof in a cold condition, the volume of the wax pellet 21 increases so that the spring seat member 17 is leftwardly moved from the position indicated by the solid lines to a position indicated by the broken lines in FIG. 1, whereby the initial setting load of the timer spring 14 resumes a normal value which is to be assumed during warm operation of the engine. Thereafter, the relationship in magnitude between the fuel pressure introduced into the hydraulic oil chamber 12 and the force of the timer spring 14 determines the axial position of the timer piston 7 within the cylinder 6, which in turn determines the circumferential position of the roller holder 3 by means of the connecting rod 9. A change in the circumferential position of the roller holder 3 causes a corresponding change in the axial operative position of the plunger of the pump relative to the circumferential phase of the drive shaft of the pump to thereby vary the injection timing along an injection timing advance characteristic at normal operation of the engine as indicated by the solid line in FIG. 2. For example, if the engine rotational speed increases, the correspondingly increased fuel pressure within the hydraulic oil chamber 12 surpasses the force of the timer spring 14 to rightwardly displace the timer piston 7 as viewed in FIG. 1 for clockwise displacement of the roller holder 3 to thereby advance the injection timing.

When the fuel pressure from the suction space 2 balances with the force of the timer spring 14 such as at constant-speed operation or constant-load operation of the engine, the valve body 19 assumes a position wherein the radial hole 34 is closed by the valve body 19, as indicated by the solid lines in FIG. 1, which causes stoppage of flow of the fuel pressure into and out of the hydraulic oil chamber 12 to lock the timer piston 7 in a fixed position, preventing large vibration of the timer piston, particularly movement of same in the injection timing retarding direction or leftward direction as viewed in the figure.

On the other hand, when the engine is stopped, the timer piston 7, the valve body 19, the spring seat member 17 return to their respective initial positions assumed before the start of the engine.

Since the invention is applied to a fuel injection control device provided with a servo valve wherein the timer spring has a small set force, the thermo-sensitive element of the spring force control device may be small in size, enabling to design the whole fuel injection control device compact in size.

Figure 3:
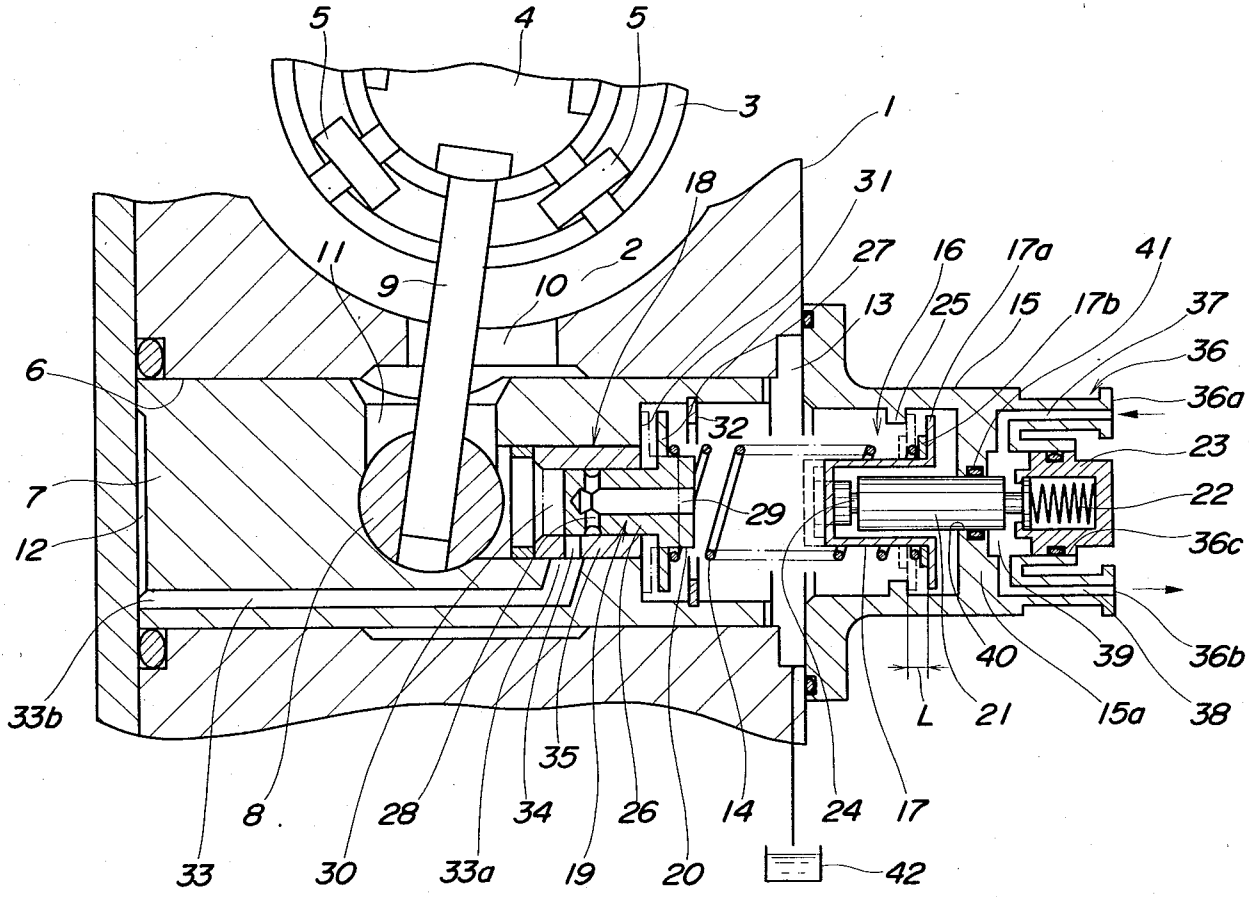
FIG. 3 is a longitudinal sectional view of an injection timing control device according to a second embodiment of the invention.

FIG. 3 shows a second embodiment of the invention. In FIG. 3, parts and elements corresponding to those in FIG. 1 are designated by identical characters, and description of which is omitted. The second embodiment is distinguished from the first embodiment of FIG. 1 in that the wax pellet 21 is arranged to sense the temperature of engine cooling water and acts such that when the engine cooling water temperature is lower than a predetermined value, the initial setting load of the timer spring 14 is reduced below a normal value which is to be assumed during warm operation of the engine, while when the engine cooling water temperature is higher than the predetermined value, the initial setting load is set to and held at the normal value.

The end wall 15*a* of the cap 15 has an integral extension 36 as a cooling water passage portion, which has a pair of diametrically opposite tubular portions 36*a* and 36*b* formed therein with passages 37 and 38, respectively, to be connected to a cooling water passageway in an internal combustion engine, not shown. The extension 36 is formed therein with a central hole 36*c* in which is force fitted a hollow tubular member 23. A cooling water space 39 is defined between the end wall 15*a* of the cap 15 and the hollow tubular member 23, which space 37 cooperates with the inlet passage 37 and the output passage 38 to form a cooling water passageway forming part of the cooling water circulation system of the engine. A wax pellet 21 is axially slidably fitted through an axial hole 40 formed in the end wall 15*a* of the cap 15 via an O-ring 41, and one end portion of which is exposed in the cooling water space 39 with its tip urged by a buffer spring 22 mounted within the hollow tubular member 23, while the other end of the wax pellet is attached to a spring seat member 17 by means of a rod 24.

The other parts and elements not described above are substantially identical in arrangement and construction with corresponding ones in the FIG. 1 embodiment. Also, the operation of this embodiment is substantially identical with the FIG. 1 embodiment, except that the wax pellet 21 operates in response to the cooling water temperature.

While preferred embodiments of the invention have been described, obviously modifications and variations are possible without departing from the scope and spirit of the present inventive concept, which are delineated by the appended claims.

What is claimed is:

1. An injection timing control device for combination with a fuel injection pump for an internal combustion engine, said pump being of the type having a suction space filled with fuel under pressure variable as a function of the rotational speed of said engine, a pumping and distributing plunger, and a roller holder carrying a plurality of rollers circumferentially arranged and disposed in camming engagement with said plunger, said injection timing control device comprising: a cylinder; a timer piston slidably received within said cylinder, said timer piston being coupled to said roller holder such that displacement thereof causes a corresponding chnage in the circumferential position of said roller holder; a first chamber defined at one end of said timer piston; a second chamber defined at an opposite end of said timer piston, said second chamber communicating with a zone under lower pressure; a timer spring accommodated within said second chamber; a communication passageway extending between said suction space of said pump and said first chamber and being located at least in part within said timer piston; servo valve means arranged across said communication passageway at a location within said timer piston, said servo valve means having a valve body displaceable relative to said timer piston against the force of said timer spring in response to a change in fuel pressure within said suction space, to selectively assume a first position where it disconnects said first chamber with respect to said valve body from said suction space and simultaneously communicates same with said second chamber, a second position where it communicates said first chamber with said suction space and simultaneously disconnects same from said second chamber, and a third position where it disconnects said first chamber from both of said suction space and said second chamber, said timer spring exerting an urging force upon said valve body; said timer spring having an initial length to apply an initial setting load to said valve body of said servo valve when said timer piston and said valve body of said servo valve means both assume initial positions just before the start of said engine; and spring force control means responsive to a temperature of said engine for changing the initial setting load of said timer spring, said spring force control means including a thermo-sensitive wax pellet element arranged in said second chamber and which is variable in volume in response to a change in the temperature of fuel within said second chamber, a spring seat member having one surface disposed in urging contact with said opposite end of said timer spring and an opposite surface urged by said thermo-sensitive wax pellet element against the urging force of said timer spring and displaceable in response to a change in the volume of said thermo-sensitive wax pellel element for changing the initial length of said timer spring, stopper means for holding the initial length of said timer spring at a value corresponding to a predetermined value of said initial setting load of said timer spring irrespective of change of the volume of said thermo-sensitive wax pellet element when the temperature of said engine is higher than a predetermined value, said stopper means being disposed to engage said spring seat member at a predetermined location for prohibiting displacement of said spring seat member toward said timer piston beyond said predetermined location, and a buffer spring urging said thermo-sensitive wax pellet element against the force of said timer spring, said buffer spring being disposed to be contracted by an increase in the volume of said thermo-sensitive wax pellet element when said spring seat member engages said stopper means, whereby when the temperature of said engine is higher than said predetermined value, the initial setting load of said timer spring is held at said predetermined value, while when the temperature of said engine is lower than said predetermined value, the initial setting load of said timer spring is reduced below said predetermined value.

2. An injection timing control device for combination with a fuel injection pump for an internal combustion engine, said pump being of the type having a suction space filled with fuel under pressure variable as a function of the rotational speed of said engine, a pumping and distributing plunger, and a roller holder carrying a plurality of rollers circumferentially arranged and disposed in camming engagement with said plunger, said injection timing control device comprising: a cylinder; a timer piston slidably received within said cylinder, said timer piston being coupled to said roller holder such that displacement thereof causes a corresponding change in the circumferential position of siad roller holder; a first chamber defined at one end of said timer piston; a second chamber defined at an opposite end of said timer piston, said second chamber communicating with a zone under lower pressure; a timer spring accommodated within said second chamber; a communication passageway extending between said suction space of said pump and said first chamber and being located at least in part within said timer piston; servo valve means arranged across said communication passageway at a location within said timer piston, said servo valve means having a valve body displaceable relative to said timer piston against the force of said timer spring in response to a change in fuel pressure within said suction space, to selectively assume a first position where it disconnects said first chamber with respect to said valve body from said suction space and simultaneously communicates same with said second chamber, a second position where it communicates said first chamber with said suction space and simultaneously disconnects same from said second chamber, and a third position where it disconnects said first chamber from both of said suction space and said second chamber, said timer spring exerting an urging force upon said valve body; said timer spring having an initial length to apply an initial setting load to said valve body of said servo vlave when said timer piston and said valve body of said servo valve means both assume initial positions just before the start of said engine; a passageway for cooling water of said engine, said passageway being provided adjacent said second chamber; and spring force control means responsive to a temperature of said engine for changing the initial setting load of said timer spring, said spring force control means including a thermo-sensitive wax pellet element which is variable in volume in response to a change in the temperature of the engine, at least part of said thermo-sensitive wax pellet element being disposed in said colling water passageway and being variable in volume in response to a change in the temperature of cooling water flowing in said cooling water passageway, the temperature of said cooling water being a function of the temperature of the engine, a spring seat member having one surface disposed in urging contact with said opposite end of said timer spring and an opposite surface urged by said thermo-sensitive wax pellet element against the urging force of said timer spring and displaceable in response to a change in the volume of said theremo-sensitive wax pellet element for changing the initial length of said timer spring, stopper means for holding the initial length of said timer spring at a value corresponding to a predetermined value of said initial setting load of said timer spring irrespective of change of the volume of said thermo-sensitive wax pellet element when the temperature of said engine is higher than a predetermined value, said stopper means being disposed to engage said spring seat member at a predetermined location for prohibiting displacement of said spring seat member toward said timer piston beyond said predetermined location, and a buffer spring urging said thermo-sensitive wax pellet element against the force of said timer spring, said buffer spring being disposed to be contracted by an increase in the volume of said thermo-sensitive wax pellet element when said spring seat member engages said stopper means, whereby when the temperature of said engine is higher than said predetermined value, the initial setting load of said timer spring is held at said predetermined value, while when the temperature of said engine is lower than said predetermined value, the initial setting load of said timer spring is reduced below said predetermined value.

* * * * *